US005758476A

United States Patent [19]

Van Den Akker et al.

[11] Patent Number: 5,758,476

[45] Date of Patent: Jun. 2, 1998

[54] CAPPING APPARATUS

[75] Inventors: Richard Henry Van Den Akker, Wimborne; John Darley, New Milton; Roy Thomas Gibbs, Poole, all of England

[73] Assignee: Carnaudmetalbox (Holdings) USA, Inc., Wilmington, Del.

[21] Appl. No.: 725,893

[22] Filed: Oct. 2, 1996

[30] Foreign Application Priority Data

Nov. 23, 1995 [GB] United Kingdom ..... 95239216

[51] Int. Cl.[6] ..... B65B 7/28

[52] U.S. Cl. ..... 53/485; 53/314; 53/315

[58] Field of Search ..... 53/485, 488, 313, 53/314, 315, 316, 367

[56] References Cited

U.S. PATENT DOCUMENTS

| | | | |
|---|---|---|---|
| 2,481,508 | 9/1949 | Gschwend et al. | 53/315 |
| 3,005,300 | 10/1961 | Shields | 53/367 |
| 3,332,210 | 7/1967 | Tordi | 53/316 |
| 3,908,341 | 9/1975 | Conti | 53/315 |
| 3,977,161 | 8/1976 | Faber et al. . | |
| 4,771,903 | 9/1988 | Levene et al. . | |
| 5,050,367 | 9/1991 | Heisler | 53/367 |

FOREIGN PATENT DOCUMENTS

| | | |
|---|---|---|
| 1145131 | 4/1966 | United Kingdom . |
| 2228729 | 1/1990 | United Kingdom . |
| 94/18108 | 2/1994 | WIPO . |

OTHER PUBLICATIONS

EP Search Report dated Jun. 11, 1996.

UK Search Report dated Jan. 10, 1996.

*Primary Examiner*—Daniel Moon

*Assistant Examiner*—John Paradiso

*Attorney, Agent, or Firm*—Diller, Ramik & Wight, PC

[57] ABSTRACT

A capping apparatus, in particular for applying PRESON™ style caps to glass jars, comprising a chute with grooved sidewalls to allow free passage of the caps irrespective of tab orientation. At the chute outlet, stops depend from a bridge bar in order to engage the leading cap above its tab, again allowing caps to be presented in random orientation.

13 Claims, 2 Drawing Sheets

CAPPING APPARATUS

BACKGROUND OF THE INVENTION

This invention relates to a capping apparatus and a method of applying caps, particularly but not exclusively "press-on" type caps, to containers such as glass jars. Generally, such capping apparatus is to be fitted above and at an angle to a horizontal conveyor, along which containers pass during the capping process.

Press-on caps, hereinafter referred to as PRESON™ caps, typically comprise a metallic disc, or panel, from which depends a polymer skirt. Around the inner circumference of the skirt are one or more ridges which snap fit over the neck of a container. An outwardly projecting tab at the base of the skirt enables the cap to be pried off the container. A sealing compound between the panel and the skirt ensures a hermetic seal is formed by the cap when it has been applied to the container.

Capping apparatus, or cappers, are known for press- on, twist-off caps, in which caps pass down a chute to a cap pick-up point at which they are collected one-by-one by containers passing beneath the end of the chute. At the cap pick-up point, the leading cap is engaged by stops just ahead of its transverse diameter which prevent the cap from falling out of the chute.

The tab of the PRESON™ cap has always been a problem when applying the caps to jars. The asymmetric nature of the cap means that the caps must be oriented so that the tab does not foul on the apparatus or on neighbouring caps either in the capper chute or during application. If the caps are not pre-oriented, then the caps may not slide freely in the chute, so that a cap is not in position for collection by the next jar/bottle. Furthermore, pre-orientation is required to ensure that the tab does not become caught on the stops at the mouth of the chute which might prevent release and also result in bottles being missed in the capping process. Conversely, if the stops are designed to accommodate the tab when in a position where the tab is presented parallel to the chute side walls, the cap may fail to be engaged by the stops and may fall out of the chute onto the bottle conveyor, requiring halting of the capping process in order to clear the conveyor. Since capping processes are high speed operations, such a situation is clearly unacceptable.

SUMMARY OF THE INVENTION

According to the present invention, there is provided a machine for applying a cap to a container, the cap having a panel, a skirt depending from the panel and a hem projecting from the base of the skirt, the machine comprising:

a chute having an outlet;

one or more stops for preventing a cap from falling out of the chute outlet; and means for biasing the cap downwardly towards the container;

in which the stop or stops extend downwardly to a point above the position where the hem projects from the cap skirt.

Usually, the stop or stops may be fixed to the biasing means. Either or both of the stop(s) and biasing means may be pivotable away from the chute to allow passage of the cap out of the chute when collected by a container. Since the caps are always applied with panel uppermost, the stops will engage the cap skirt above the hem. Thus the hem may be asymmetric, for example comprising an outwardly projecting tab at the base of the skirt, without the orientation of the cap being critical.

Accordingly, in a second aspect of the present invention, there is provided a machine for applying a cap to a container, the cap having a panel, a skirt depending from the panel and an outwardly projecting tab at the base of the skirt, the machine comprising:

a chute having an outlet;

one or more stops for preventing a cap from falling out of the chute outlet; and means for biasing the cap downwardly towards the container;

in which the stop or stops extend downwardly to a point above the position where the tab projects from the cap skirt.

The chute may include grooves at the base of each side wall. If the cap enters the chute with its tab transverse to the chute, the tab may thus pass within one of the grooves. This further facilitates feeding of the caps to the chute since there is no need for the caps to be oriented within the chute itself.

Typically, the machine comprises means for holding the cap at the chute outlet. In addition, the machine may further comprise means for attracting the leading edge of the cap upwardly away from the container as the biasing means biases the trailing edge of the cap downwardly towards the container. This attraction means may comprise one or more magnets in accordance with our patent application PCT/GB94/00235 (UK patent application 93029098).

The chute base may usually be flat so as to facilitate cap sliding along the chute. The chute outlet may include inwardly projecting wings which support the front of skirt of the leading cap and a central tongue extending from the chute base to support the rear of the cap skirt.

The biasing means may comprise a bar which may be pivotable about its rear portion so that the front of the bar is moveable upwardly away from the chute outlet to allow passage of the cap when collected by a container. Alternatively, the stop or stops may be pivotable to allow passage out of the chute in the same manner.

Generally, two stops are positioned either side of the centre of the bar, with the distance between the stops being slightly less than the widest dimension of the cap skirt, above the tab. In this way, the leading cap will be held just before its widest point, excluding the tab.

In a preferred embodiment, the tongue and wings at the chute outlet may be spaced from each other so that when the cap is picked up by a container, the cap is free to pivot about the rear edges of the wings once it has been pulled forward off the chute tongue. Typically, the cap skirt may be of polymeric material which, when softened, for example by steam, is deformable. This deformation, in combination with the pivoting action about the wings, enables the cap to pass beneath the stops, overcoming the biasing action of the bridge bar.

Alternatively, the stops may be grooved at their upper inside faces so that the distance between the grooved portions of the stops is at least the same as the widest dimension of the cap, including its tab. Thus, when a bottle collects the cap from the chute, the cap may be lifted over the narrow part of the stops and between the grooved portions. Clearly alternative configurations are possible in which the stops are independently pivotable or are connected to the bar by separate components providing that the widest part of the cap can still pass between such components.

According to a further aspect of the present invention, there is provided a method of applying a cap to a container, the cap having a panel, a skirt depending from the panel and a hem at the base of the skirt, the method comprising the steps of:

passing a cap along a chute to a chute outlet;

retaining the cap at the chute outlet prior to pickup of the cap by the container; and picking up the cap from the chute outlet;

in which the retaining step comprises engaging the skirt of the cap above the tab.

Preferably, the pick-up step comprises: engaging the front edge of the cap; pulling the cap forward off a rear portion of the chute outlet; pivoting the cap about a front portion of the chute outlet; drawing the cap beneath the stops; and biasing the trailing edge of the cap towards the container.

The retaining step may further comprise applying a restraining force to the cap panel for holding the cap down on the chute.

A preferred embodiment of the invention will now be described, by way of example only, with reference to the drawings, in which:

DESCRIPTION OF THE PREFERRED EMBODIMENTS

Figure 1:
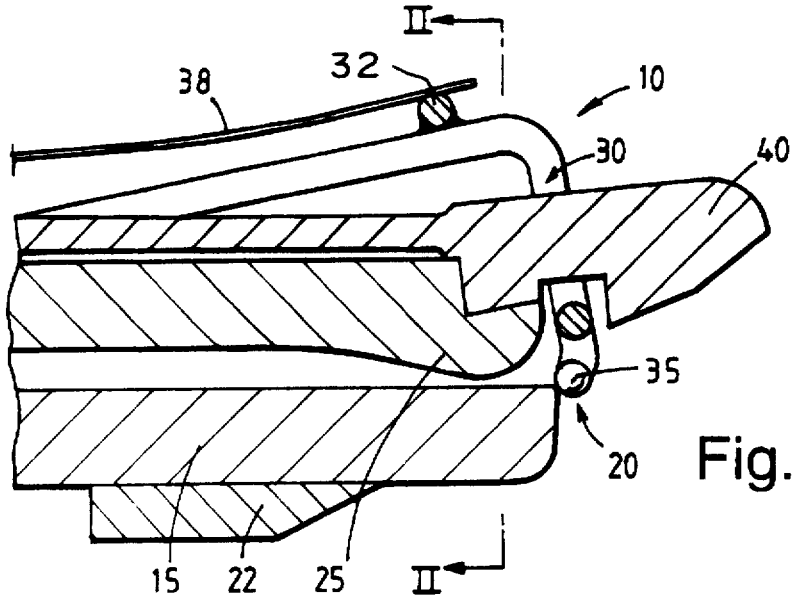
FIG. 1 is a side section of the chute outlet of a capping apparatus.

FIG. 1 shows the front portion of a capping apparatus 10 according to the invention. The capper 10 comprises a chute 15 along which caps 60 pass to a pick-up point at the chute outlet 20. At the chute outlet 20, the cap 60 is supported by a tongue 22 which extends from a base 18 of the chute 15 and by inwardly facing wings 54 on front and rear rail clips 50, 52 which will be described with reference to FIG. 6 below.

The leading cap is held down on the chute 15 by a "hold down" 25 and is prevented from falling out of the chute 15 by stops 35 on bridge bar 30. The bridge bar 30 is biased downwards by means of spring 38 and is pivotable about its rear end (see FIG. 3) at pivots 42, 42 defining a fulcrum of the bridge bar 30. A slide block 40 extends beyond the chute outlet 20 (to the right as viewed in FIG. 1), and is used to guide the cap 60 to the correct position for alignment with the bottle neck.

Figure 2:
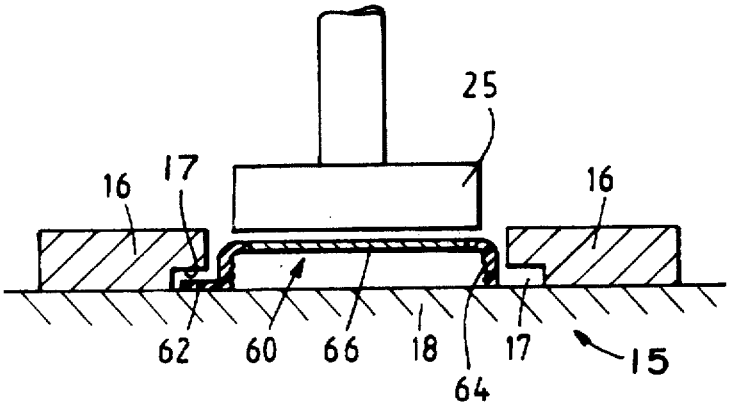
FIG. 2 is a section through II-II on FIG. 1.

In FIG. 2, a cap 60 is shown in position on the chute 15. The cap 60 is of the PRESON™ type and has a metal central panel 66 and a polymer skirt 64 and a radially outwardly projecting tab 62. The chute 15 comprises side walls 16 and a base 18. The tab 62 of the cap extends sideways from the cap skirt 64, into a groove 17 in one of the side walls. Both side walls have grooves 17, so that the orientation of the cap is not important within the chute 15. It can be seen that the transverse cross-section shape of the side walls 16 is L-shaped. The top (unnumbered) of the side walls 16 is thus narrower than the base so that undue lateral movement of the cap 60 is prevented by engagement of the cap skirt 64 by the upper side walls.

Figure 3:
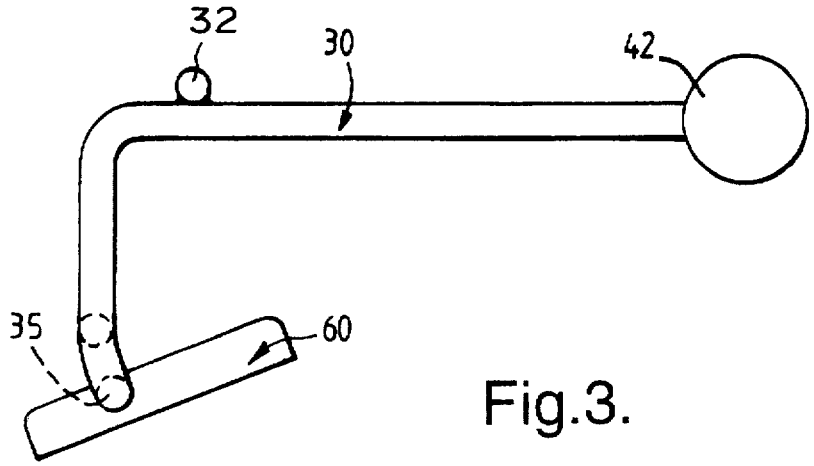
FIG. 3 is a side view of the bridge bar, showing a cap in position.
Figure 4:
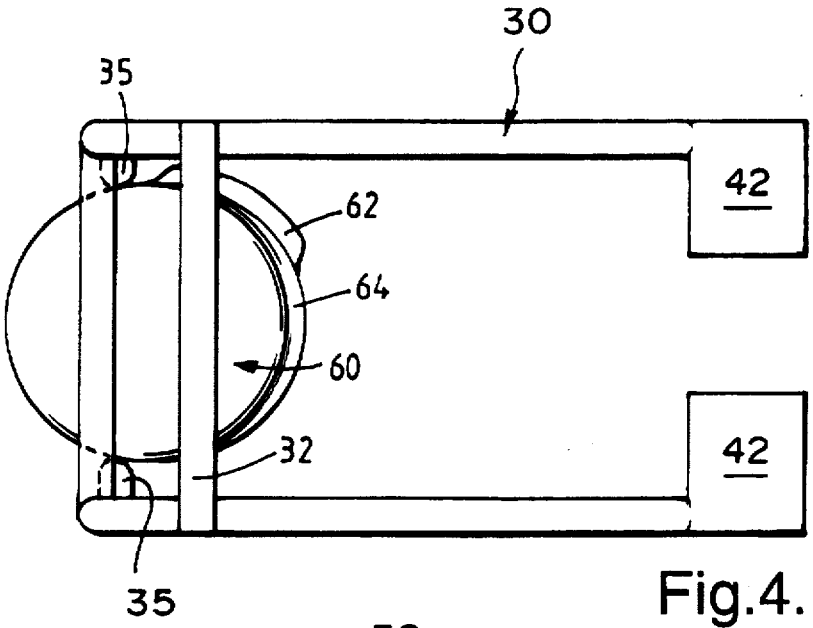
FIG. 4 is a plan view of the bridge bar, showing a cap in position.
Figure 5:
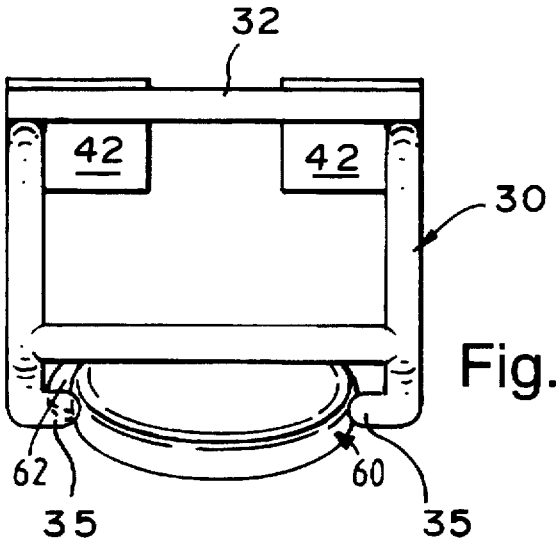
FIG. 5 is a front view of the bridge bar, again showing the cap in position for collection.

Bridge bar 30 is shown in different views in FIGS. 3 to 5, with cap 60 shown in retained position in each figure. As is noted above, stops 35 on the bridge bar extend approximately perpendicularly to the base of the chute 15 in order to retain the cap 60 just ahead of its diameter. Although in FIG. 4, the tab 62 is not adjacent to either of the stops 35 so that the stops of a known capper would not require modification in this instance, it is apparent in FIG. 5 that the stops 35 of the present invention are above the tab position so that the tab 62 will readily sit beneath the stops 35 if oriented across the chute.

The bridge bar 30 is pivotable about fulcrum 42 for biasing purposes as described earlier and below, with the spring 38 acting on a secondary bar 32.

Figure 6:
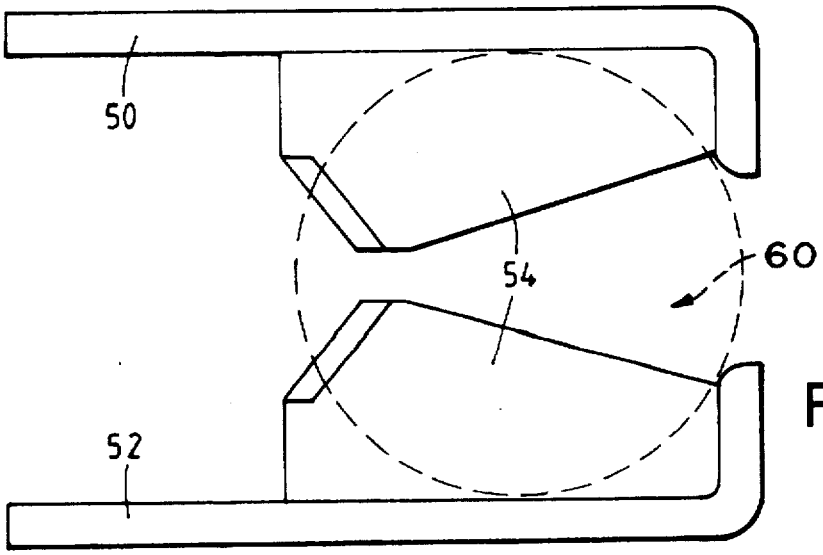
FIG. 6 is a plan view of the chute outlet.

In use, caps are steam heated to soften the polymeric material of the cap skirt and are fed panel uppermost down the chute 15, with their tabs 62 randomly oriented, until engaged by the stops 35 on the bridge bar 30 at the chute outlet 20, with the rear of the cap 60 resting on tongue 22 of the chute base. Unlike prior art cappers, the stops 35 are provided solely above the cap 60. No stops are required on front and rear rail clips 50, 52 at the chute outlet 20 but wings 54 are still provided to support the front of the leading cap as shown in FIG. 6. Hold down 25 guides the caps towards the chute outlet 20 and prevents twisting of the caps out of the chute 15.

Containers such as glass bottles or jars pass along a horizontal conveyor under the capper. The leading edge of a jar impinges on a cap held at the chute outlet 20, pulling the cap forward as the jar is moved along its horizontal conveyor. The steam softened skirt of the cap deforms as the cap is pulled forward against the action of the rigid stops 35. Since the tongue 22 and wings 54 are spaced from each other, this forward action of the jar will also cause the cap to be drawn off the tongue 22 of the chute and tilt towards the horizontal, pivoting about the rear edge of wings 54. The dropping of the cap 60 off the tongue is believed to be the biggest influence in release of the cap from the chute.

As the cap drops down away from the stops 35 and the plastic skirt 64 deforms, the forward motion of the cap 60 eventually overcomes the downward force of the bridge bar 30 and the restraining interference force of the stops 35. The stops 35 then move up the crown radius of the cap 60 in a camming action as the bridge bar 30 pivots about fulcrum 42. This camming action further assists release of the cap 60.

Once the cap exits the chute, the secondary bar 32 of the bridge bar 30 acts on the rear half of the cap as the spring 38 forces the bridge bar 30 to pivot back to its "at rest" position to assist in ensuring that the cap 60 sits correctly on the jar. The slide block 40 may include magnets which attract the front of the cap upwards so as to cooperate with the bridge bar in achieving this correct positioning. Once the bar is in its "at rest" position, the stops are correctly positioned to halt the following cap.

It has been found that the capping process using the apparatus of the present application can achieve capping speeds of just over 600 caps/min and capping speeds of 800 caps/minute are considered possible.

Although a preferred embodiment of the invention has been specifically illustrated and described herein, it is to be understood that minor variations may be made in the apparatus without departing from the spirit and scope of the invention, as defined the appended claims.

We claim:

1. A machine for applying a cap defined by an end panel, a peripheral skirt having an exterior diameter and a radially outwardly directed tab at a lowermost peripheral edge of the peripheral skirt to an associated container comprising a chute terminating at a chute outlet, a hold down for holding each cap down upon said chute adjacent said chute outlet, a bridge bar having opposite end portions, a first of said end portions including pivot means for pivotally mounting said bridge bar to effect movement of a second of said bridge bar end portions adjacent said chute outlet toward and away from said chute, means for biasing said bridge bar second end portion downwardly toward said chute, and a pair of opposing stop means carried by said bridge bar second end portion spaced from each other a distance less than the exterior diameter of the cap peripheral skirt whereby said pair of opposing stop means hold each cap projecting at least partially beyond said chute outlet for withdrawal therefrom by an associated container.

2. The cap applying machine as defined in claim 1 wherein said chute includes a pair of spaced wings adjacent said chute outlet in opposing relationship to said hold down.

3. The cap applying machine as defined in claim 1 wherein said chute includes a pair of opposite side walls defining grooves opening toward each other in opposing relationship and being adapted to selectively receive therein a cap tab.

4. The cap applying machine as defined in claim 1 wherein said bridge bar is defined by a pair of opposite side bridge bars and a transverse bar therebetween, and said transverse bar is disposed generally in spaced overlying relationship to said pair of opposing stop means.

5. The cap applying machine as defined in claim 1 wherein said bridge bar is defined by a pair of opposite side bridge bars and a transverse bar therebetween, said transverse bar is disposed generally in spaced overlying relationship to said pair of opposing stop means, and said pair of opposite stop means include a stop carried by a terminal end portion of each side bridge bar.

6. The cap applying machine as defined in claim 2 wherein said chute includes a pair of opposite side walls defining grooves opening toward each other in opposing relationship and being adapted to selectively receive therein a cap tab.

7. The cap applying machine as defined in claim 2 wherein said bridge bar is defined by a pair of opposite side bridge bars and a transverse bar therebetween, and said transverse bar is disposed generally in spaced overlying relationship to said pair of opposing stop means.

8. The cap applying machine as defined in claim 2 wherein said bridge bar is defined by a pair of opposite side bridge bars and a transverse bar therebetween, said transverse bar is disposed generally in spaced overlying relationship to said pair of opposing stop means, and said pair of opposite stop means include a stop carried by a terminal end portion of each side bridge bar.

9. The cap applying machine as defined in claim 3 wherein said bridge bar is defined by a pair of opposite side bridge bars and a transverse bar therebetween, and said transverse bar is disposed generally in spaced overlying relationship to said pair of opposing stop means.

10. The cap applying machine as defined in claim 3 wherein said bridge bar is defined by a pair of opposite side bridge bars and a transverse bar therebetween, said transverse bar is disposed generally in spaced overlying relationship to said pair of opposing stop means, and said pair of opposite stop means include a stop carried by a terminal end portion of each side bridge bar.

11. The cap applying machine as defined in claim 7 wherein said chute includes a pair of opposite side walls defining grooves opening toward each other in opposing relationship and being adapted to selectively receive therein a cap tab.

12. The cap applying machine as defined in claim 8 wherein said chute includes a pair of opposite side walls defining grooves opening toward each other in opposing relationship and being adapted to selectively receive therein a cap tab.

13. A method of applying a cap to a container in which the cap includes an end panel, a peripheral skirt having an exterior diameter and a radially outwardly directed tab at a lowermost peripheral edge of the peripheral skirt and spaced an axial distance from the cap end panel comprising the steps of feeding a cap along a chute to a chute outlet, holding the cap down against an underlying supporting surface of the chute, pivoting one end of a bridging bar at a location such that a second end of the bridging bar is located adjacent the chute outlet with opposing stops contacting the peripheral skirt above the tab at points spaced from each other less than the peripheral skirt exterior diameter, biasing the bridging bar second end in a direction toward the chute, and drawing the cap from beneath the stops and onto a container.

* * * * *